US008132554B2

(12) United States Patent
Koenen

(10) Patent No.: US 8,132,554 B2
(45) Date of Patent: Mar. 13, 2012

(54) FUEL SHUTOFF SYSTEM

(75) Inventor: Robert Koenen, Pewaukee, WI (US)

(73) Assignee: Briggs And Stratton Corporation, Wauwatosa, WI (US)

( * ) Notice: Subject to any disclaimer, the term of this patent is extended or adjusted under 35 U.S.C. 154(b) by 756 days.

(21) Appl. No.: 12/335,882

(22) Filed: Dec. 16, 2008

(65) Prior Publication Data

US 2010/0147264 A1 Jun. 17, 2010

(51) Int. Cl.
*F02B 77/08* (2006.01)
*F02D 17/00* (2006.01)

(52) U.S. Cl. ..... 123/198 D; 123/198 DB; 123/198 DC

(58) Field of Classification Search ..... 123/198 D, 123/198 DB, 198 DC
See application file for complete search history.

(56) References Cited

U.S. PATENT DOCUMENTS 3,191,585 A 6/1965 Craft
3,993,038 A 11/1976 Alt et al.
5,301,644 A 4/1994 Olmr

*Primary Examiner* — Noah Kamen
(74) *Attorney, Agent, or Firm* — Andrus, Sceales, Starke & Sawall, LLP

(57) ABSTRACT

A fuel control system that has a fuel control device to control the flow of fuel to a carburetor of an internal combustion engine. The fuel control device includes a control member that is movable between a first position and a second position to control the flow of fuel into a carburetor. When a kill switch within the fuel control system is closed, induced current from a primary ignition coil within the internal combustion engine is fed through an electromagnetic coil, causing the fuel flow control device to interrupt the supply of fuel to the carburetor. Thus, when an operator desires to stop the internal combustion engine, the kill switch closes and the fuel control device interrupts the supply of fuel to the carburetor to prevent backfires.

19 Claims, 4 Drawing Sheets

FUEL SHUTOFF SYSTEM

BACKGROUND OF THE INVENTION

The present disclosure generally relates to the control of a supply of fuel in an internal combustion engine. More specifically, the present disclosure relates to a control system that interrupts the flow of fuel to an internal combustion engine when the engine has been turned off.

Small internal combustion engines are used to power lawn and garden equipment, walk behind lawn mowers, snow blowers, tillers, garden tractors, pressure washers, electrical generators and the like. Such engines include carburetors that receive fuel from a fuel tank. The fuel from the storage tank is mixed with air in a carburetor and the fuel/air mixture is supplied into an engine cylinder where the fuel/air mixture is ignited by a spark plug. Following ignition, during the exhaust stroke of the engine, the combustion gases are forced from the cylinder through a muffler.

In many applications of small internal combustion engines, the engine includes a kill switch that, when closed, shorts the electrical ignition system to ground to prevent further operation of the spark plugs. Although such a kill switch effectively kills the operation of the engine quickly, the engine does not immediately stop revolving but continues to revolve for several rotations due to the inertial forces of the moving components within the engine. During this continuing rotation, the movement of the piston within the cylinder continues to draw the fuel/air mixture from the carburetor into the cylinder. Since the spark plug ignition is interrupted, the unburned fuel mixture is forced from the cylinder into the heated muffler. When the muffler is sufficiently heated after a period of continuous operation, hot spots in the muffler can cause the ignition of the unburned fuel mixture. The ignition of the fuel mixture within the muffler creates a phenomenon called a backfire that not only generates a loud noise, but can damage the muffler.

One attempt to prevent the discharge of unburned fuel into a heated muffler utilizes an arrangement that prevents the flow of fuel into the carburetor almost immediately after operation of the kill switch. These fuel flow interrupt devices typically require a stored electrical charge from either a storage battery or storage capacitor to supply the power required to move a valve element to prevent the flow of fuel. In such systems, a storage capacitor is charged during operation of the internal combustion engine and, once the kill switch is activated, the stored charge from the storage capacitor is used to charge an electromagnetic coil that moves a valve element to restrict the flow of fuel into the carburetor.

In yet another system, a battery is included in the fuel supply system to move a fuel interrupt solenoid. However, in such a system, the battery requires an alternator to charge the battery during usage of an internal combustion engine. In each of the systems described above, additional circuitry is required to be included with the fuel supply system, such as an alternator to charge the battery or capacitor.

SUMMARY OF THE INVENTION

The present disclosure provides a fuel control system for cutting off the supply of fuel to an internal combustion engine when the engine is being stopped. The fuel control system of the disclosure prevents the supply of fuel to a carburetor to prevent backfiring.

During normal operation of an internal combustion engine, the rotating flywheel within the engine induces current within a primary ignition coil. When the engine is operating properly, the induced current within the primary ignition coil induces a voltage across a secondary ignition coil, thus causing the operation of a spark plug.

The fuel control system of the present disclosure includes a fuel flow control device that is positioned to restrict the supply of fuel to the carburetor of the internal combustion engine upon closure of a kill switch. The fuel flow control device preferably includes a movable control member. When the control member is in its first, retracted position, the control member allows fuel to flow from a fuel bowl for the engine into the carburetor, where the fuel is mixed with air and supplied to the individual cylinders of the internal combustion engine. The control member can also be moved into a second, extended position in which the control member dramatically restricts the flow of fuel from the fuel bowl into the carburetor. In one embodiment of the present disclosure, the control member includes an expanded head portion that blocks the flow of fuel into the carburetor from the fuel bowl when the control member is in its extended position.

The fuel flow control device further includes an electromagnetic coil that is positioned to surround the movable control member. When the electromagnetic coil is energized, the electromagnetic coil creates a magnetic field that draws the movable control member from its first, retracted position to its second, extended position. When the electromagnetic coil is no longer energized, a bias force moves the control member back to its first, retracted position. In this manner, the control member allows the flow of fuel at all times except when the electromagnetic coil is energized.

The fuel control system includes a kill switch positioned between the electromagnetic coil of the fuel flow control device and ground. When a user/operator desires to kill operation of the internal combustion engine, the kill switch is moved from a first condition to a second condition. When the kill switch is in the second condition, the kill switch both disables the activation of the spark plugs and provides a path to ground for the discharge of the primary ignition coil.

When the kill switch is moved to the second condition, the current induced in the primary ignition coil by rotation of the flywheel of the internal combustion engine is supplied to the electromagnetic coil of the fuel flow control device, since the primary ignition coil is connected to ground through the kill switch. After the operation of the internal combustion engine has been interrupted, the flywheel continues to rotate, which continues to induce current through the primary ignition coil. The induced current from the primary ignition coil energizes the electromagnetic coil of the fuel flow control device, thus causing the control member to move to its second, extended position. When the control member is in the second, extended position, the control element dramatically restricts the flow of fuel into the carburetor.

In one embodiment of the present disclosure, a capacitor is positioned between the primary ignition coil and the electromagnetic coil of the fuel flow device while a diode is positioned in parallel with the electromagnetic coil. The combination of the capacitor and diode circuit prevents the voltage applied to the electromagnetic coil from reversing polarity and going negative. Thus, the combination of the capacitor and the diode ensures that only positive voltage is applied to the electromagnetic coil, thereby increasing the holding force on the control member.

BRIEF DESCRIPTION OF THE DRAWINGS

The drawings illustrate the best mode presently contemplated of carrying out the invention. In the drawings.

DETAILED DESCRIPTION OF THE PRESENT INVENTION

Figure 1:
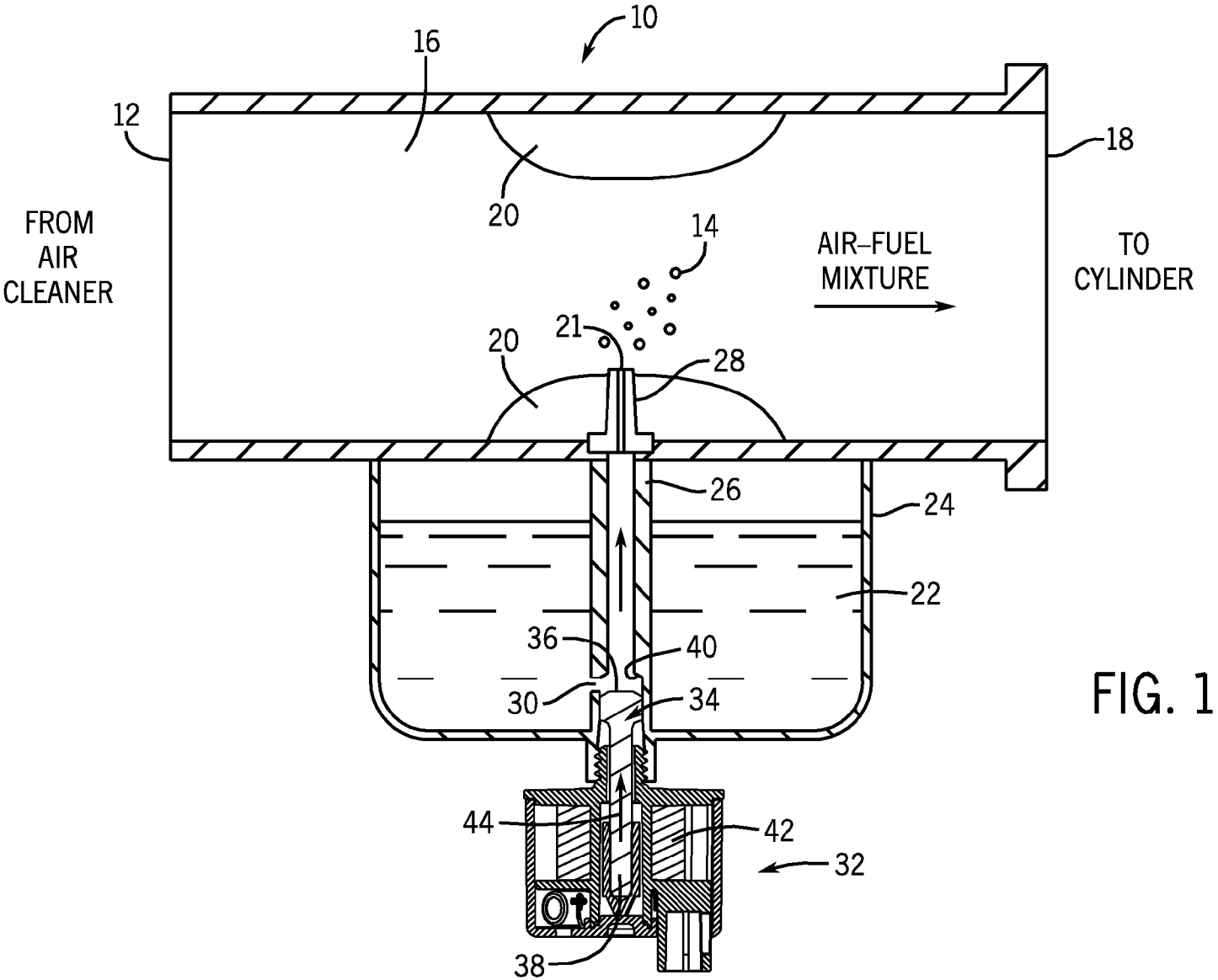
FIG. 1 is a cross-sectional view of a carburetor and fuel tank including the fuel control system of the present disclosure.

FIG. 1 illustrates a carburetor 10 that provides the required air-fuel mixture to one or more cylinders of an internal combustion engine. The engine (not illustrated) may be a small, air-cooled, four-stroke internal combustion engine. The engine may be configured with a power output as low as about 1 hp and as high as about 35 hp to operate engine-driven outdoor power equipment (e.g., walk behind lawn mowers, snow blowers, tillers, garden tractors, pressure washers, electrical generators, weed trimmers and the like). The engine may be configured as a single-cylinder vertical shaft engine, as a two-cylinder or multi-cylinder engine, or as a horizontal shaft engine. The carburetor 10 receives air from an air cleaner at an inlet 12 and mixes the air with supply of fuel 14 within an internal mixing chamber 16. The air-fuel mixture leaves the carburetor 10 at an outlet 18 that is connected to one or more cylinders of an internal combustion engine. The carburetor 10 includes a pair of flow restrictors 20 that reduce the flow area for the air within the mixing chamber 16. The reduction in the flow area decreases the pressure above a fuel inlet opening 21, which draws a supply of fuel 22 from a fuel bowl 24 through an emulsion tube 26. The flow of fuel through the emulsion tube 22 is directed into the open mixing chamber 16 through a flow nozzle 28 having the fuel inlet opening 21 sized to create the spray of fuel vapor 14, as illustrated. During normal operation of the internal combustion engine, the low pressure in the combustion chamber of each cylinder draws relatively high pressure outside air through the inlet 12. The flow of air over the nozzle 28 draws fuel 22 from the fuel bowl 24 where the fuel is vaporized and mixed into the air, as is well known.

In the embodiment shown in FIG. 1, the fuel 22 is drawn into the emulsion tube 26 through an inlet opening 30 submerged below the fuel level in the bowl 24. Since the supply of fuel introduced into the air flow within the mixing chamber 16 is created by the low pressure in the combustion chambers of each cylinder, as long as the internal combustion engine continues to operate, fuel 22 is drawn into the mixing chamber 16.

In the embodiment shown in FIG. 1, a fuel flow control device 32 is shown positioned to control the flow of fuel 22 from the fuel bowl 24 into the mixing chamber 16 of the carburetor 10. In the schematic illustration shown in FIG. 1, the fuel flow control device 32 includes a control member 34 that is selectively movable to interrupt the flow of fuel into the emulsion tube 26. In the embodiment shown in FIG. 1, the control member 34 is a movable plunger having a head portion 36 mounted to an extending shaft 38. In the position shown in FIG. 1, the control member 34 is in a first, retracted position in which fuel can flow through the inlet opening 30 and into the emulsion tube 26. When the control member 34 is moved upward in FIG. 1, the head portion 36 contacts an internal seat 40 formed within the emulsion tube 26 to prevent the flow of fuel through the inlet opening 30. In this manner, the movement of the control member 34 between its first, retracted position and its second, extended position controls the flow of fuel into the carburetor 10.

In the embodiment shown in FIG. 1, the fuel flow control device 32 includes an electromagnetic coil 42 that surrounds the shaft portion 38 of the control member 36. Preferably, the shaft 38 includes a ferromagnetic material such that when the electromagnetic coil 42 is energized, the electromagnetic coil 42 produces a magnetic field that pushes the shaft 38 in the upward direction, as shown by arrow 44. Thus, as can be understood in FIG. 1, when an energization voltage is applied to the electromagnetic coil 42, the electromagnetic coil 42 causes the control member 34 to move upward and restrict the flow of fuel 22. The physical configuration of the fuel flow control device 32 is such that gravity provides a bias force to move the control element 34 to its first, retracted position shown in FIG. 1 when no driving voltage is applied to the electromagnetic coil 42.

In the embodiment shown in FIG. 1, the fuel control device 32 is shown in a position in which the fuel control device 32 is vertically oriented and operates to prevent the flow of fuel through the inlet opening 30. However, it is contemplated that the fuel control device could have various different configurations and could be positioned in different locations to restrict the flow of fuel into one or more of the engine cylinders. As an example, the fuel flow control device 32 could be horizontally positioned and include a biased spring to create the bias force to hold the control element in a first, retracted position. Additionally, the fuel flow control device could be positioned at other locations within the fuel supply system. As an example, the fuel flow control device could be positioned to lock or close the fuel inlet opening 21 or close an air vent (not shown), creating a vacuum that prevents fuel flow. As can be understood by the alternate embodiment described, in accordance with the present disclosure, the fuel flow control device severely restricts the supply of fuel to one or more of the engine cylinders upon activation of the fuel flow control device. The specific location and configuration of the fuel flow control device can vary while operating within the scope of the present disclosure.

Figure 2:
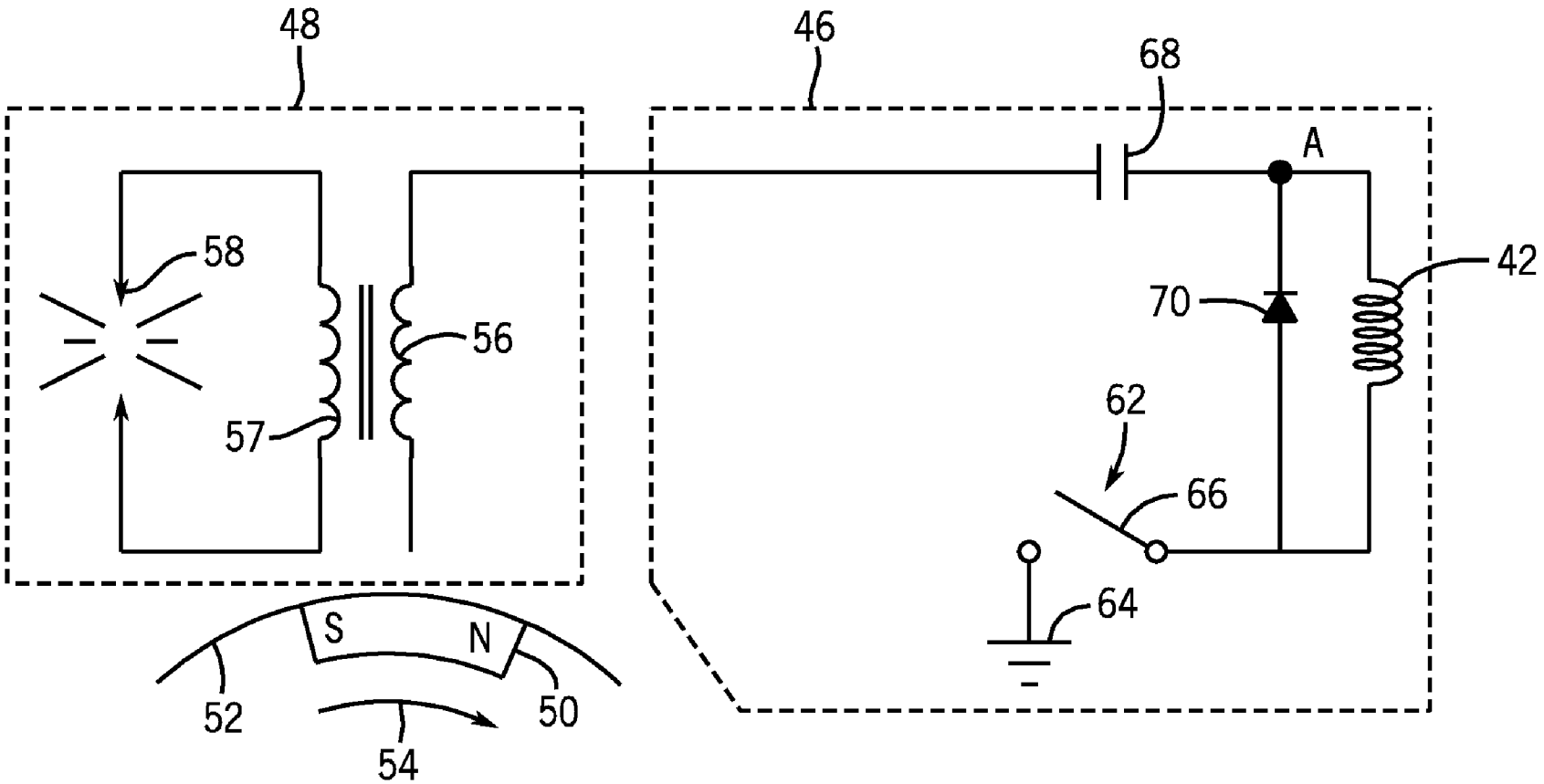
FIG. 2 is an electrical schematic illustration of the fuel control system of the present disclosure.

FIG. 2 schematically illustrates a fuel control system 46 constructed in accordance with the present disclosure. The fuel control system 46 is shown in FIG. 2 connected to a conventional ignition circuit 48 used with an internal combustion engine. The ignition circuit 48 includes a permanent magnet 50 contained on a flywheel 52 that rotates in the direction shown by arrow 54. As the permanent magnet 50 approaches a primary ignition coil 56, an electric current is induced in the primary ignition coil 56. The primary ignition coil 56 transfers the induced voltage to a secondary ignition coil 57, which creates the high voltage required for the spark plug 58.

During operation of the internal combustion engine, the flywheel 52 continuously rotates, thus inducing a voltage across the primary ignition coil 56, which is transferred to the secondary coil 57 to provide the required spark from the spark plug 58 to ignite the air-fuel mixture within the combustion chamber of each cylinder. The combustion in each cylinder results in the continued rotation of the flywheel 52.

In prior systems, when an operator desires to shut off the engine, the operator closes a kill switch, which typically grounds the primary ignition coil and prevents further operation of the spark plugs. The operation of the kill switch in such a system immediately interrupts the generation of additional sparks within the combustion chamber of each cylinder.

Immediately after the closure of the kill switch, the engine continues to rotate due to inertia. Thus, as the engine continues to turn, the rotating flywheel 52 continues to induce current within the primary ignition coil 56.

In accordance with the present disclosure, after the operation of the engine has been terminated due to activation of the kill switch, the fuel control system 46 shown in FIG. 2 utilizes the current induced in the primary ignition coil 56 caused by the stored rotational inertia of the rotating flywheel to operate the fuel flow device 32 to prevent additional fuel from flowing into the carburetor. This "scavenged current" induced in the primary ignition coil 56 by the rotational inertia of the rotating flywheel is energy previously un-utilized and dissipated through heat loss in prior systems.

In the embodiment shown in FIG. 2, the fuel control system 46 includes the electromagnetic coil 42 of the fuel flow control device 32 shown in FIG. 1. The fuel control system 46 further includes a kill switch 62 that is connected between the electromagnetic coil 42 and ground 64. In the embodiment shown in FIG. 2, the kill switch 62 is a normally open switch and closes only upon the operator's desire to discontinue operation of the internal combustion engine.

Upon activation of the kill switch 62, the primary ignition coil 56 is connected to ground 64 through the capacitor 68, the electromagnetic coil 42 and the closed contact element 66. Thus, scavenged current induced in the primary ignition coil 56 by the rotating flywheel 52 flows to ground through the electromagnetic coil 42. As discussed previously with reference to FIG. 1, when the induced current from the primary ignition coil 56 flows through the electromagnetic coil 42, the electromagnetic coil 42 causes the control element 34 to move upward in the direction shown by arrow 44 to close the inlet opening 30 and thus prevent any additional fuel flow into the carburetor 10. Thus, immediately after the kill switch 62 is closed, the induced current from the primary ignition coil 56 flows through the electromagnetic coil 42, causing the control member of the fuel flow control device to immediately restrict the flow of fuel into the carburetor 10.

As the inertia of the flywheel 52 decreases upon termination of the engine operation, the induced current within the primary ignition coil 56 is first reduced and ultimately eliminated when the flywheel comes to a stop. As the rotation of the flywheel 52 slows to a stop, the magnetic force created by the electromagnetic coil 42 is no longer sufficient to hold the control element 34 in its extended, fuel-restricting position. At this time, the control element 34 returns to its retracted position through the bias force of gravity. However, since the flywheel 52 is no longer rotating, the engine has stopped and no additional air-fuel mixture is drawn into the cylinders of the internal combustion engine. Thus, the fuel control system 46 functions to immediately restrict the supply of fuel to the carburetor upon activation of the kill switch 62.

Figure 5:
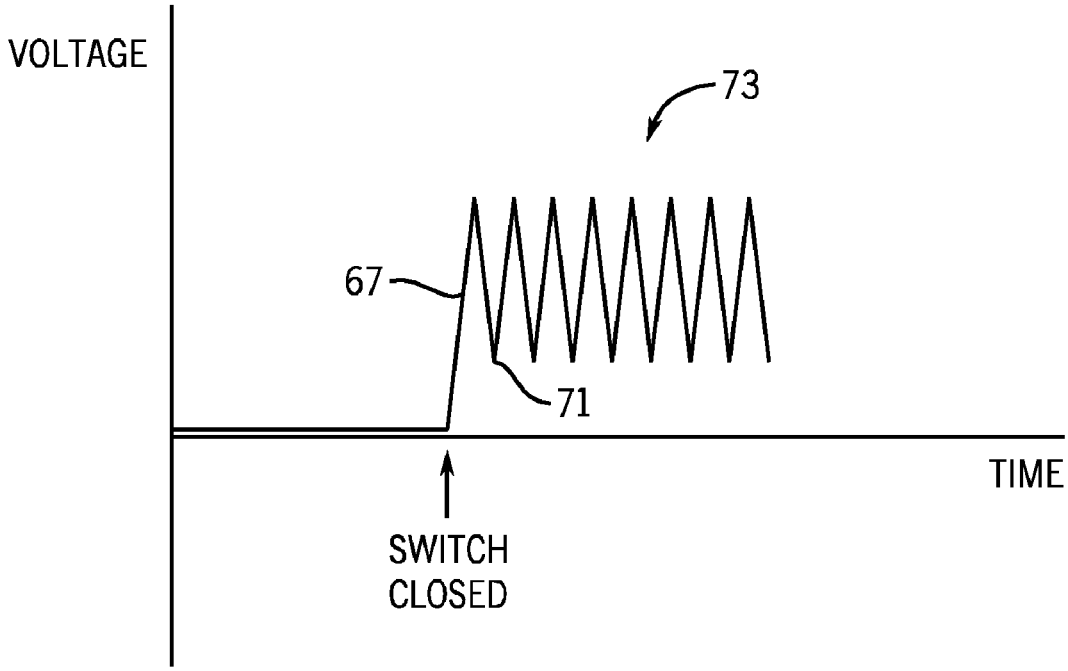
FIG. 5 is a voltage trace showing the voltage applied to the electromagnetic coil of the fuel flow control device after operation of the kill switch.

In the embodiment shown in FIG. 2, the fuel control system 46 includes both a capacitor 68 positioned between the primary ignition coil 56 and the electromagnetic coil 42 and a diode 70 positioned across the coil 42. Referring now to FIG. 5, thereshown is the voltage between point A in FIG. 2 and ground after closure of the kill switch 62 in FIG. 2. As illustrated in FIG. 5, the voltage across the capacitor 68 is approximately zero until the kill switch is closed. Immediately upon closure of the kill switch, the voltage 67 spikes due to the flow of the scavenged current from the primary ignition coil 56 to ground through the capacitor 68.

Figure 6:
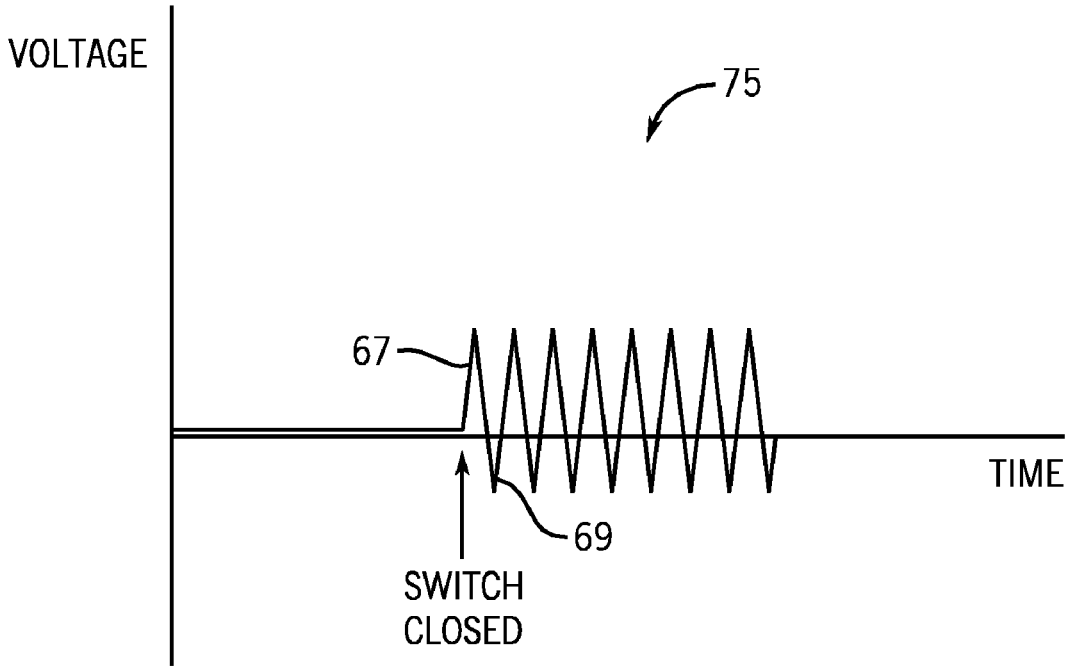
FIG. 6 is a voltage trace showing the voltage applied to the electromagnetic coil of the fuel flow control device when the diode is removed from the fuel control system.

During rotation of the flywheel past the primary ignition coil 56, the current induced in the primary ignition coil 56 has both a positive and a negative value due to the rotation of both poles of the permanent magnets past the ignition coil. FIG. 6 illustrates an embodiment of FIG. 2 in which the diode 70 has been removed. As indicated in FIG. 6, when the kill switch is closed, the voltage 67 immediately spikes. However, as the flywheel continues to rotate, the reverse flow of current causes the voltage applied to the electromagnetic coil 42 to fall below zero, as indicated by the negative portion 69 of the voltage graph shown in FIG. 6. In a circuit that does not include the diode 70, the net resultant voltage applied to the electromagnetic coil 42 may not be sufficient to move the control member to its second, extended position (depending on the total energy induced in the ignition system). Instead, the control element simply oscillated between a retracted position and a partially extended condition.

In the embodiment shown in FIG. 2, the diode 70 is positioned in parallel with the electromagnetic coil 42 such that when the induced current reverses direction, ground potential 64 is applied to point A. Thus, the voltage shown in FIG. 5 drops to a low point 71, which is slightly above zero. The effect of the combination of the capacitor 68 and the diode 70 elevates the entire voltage trace 73, as compared to the voltage trace 75 shown in FIG. 6 in which the diode 70 has been removed. The elevation of the entire voltage trace 73 above zero provides the required voltage to the electromagnetic coil 42 to hold the control element in its second, extended position.

As illustrated in FIG. 5, no current is supplied to the capacitor 68 until the kill switch 62 has been activated (i.e., after the engine stops running). Immediately upon activation of the kill switch 62, the scavenged current from the primary ignition coil 56 is applied to the electromagnetic coil 42 through the capacitor 68. The diode 70 functions to elevate the entire voltage trace 73 shown in FIG. 2 such that the electromotive force created by the electromagnetic coil 42 is sufficient to hold the control member in its extended condition.

Figure 4:
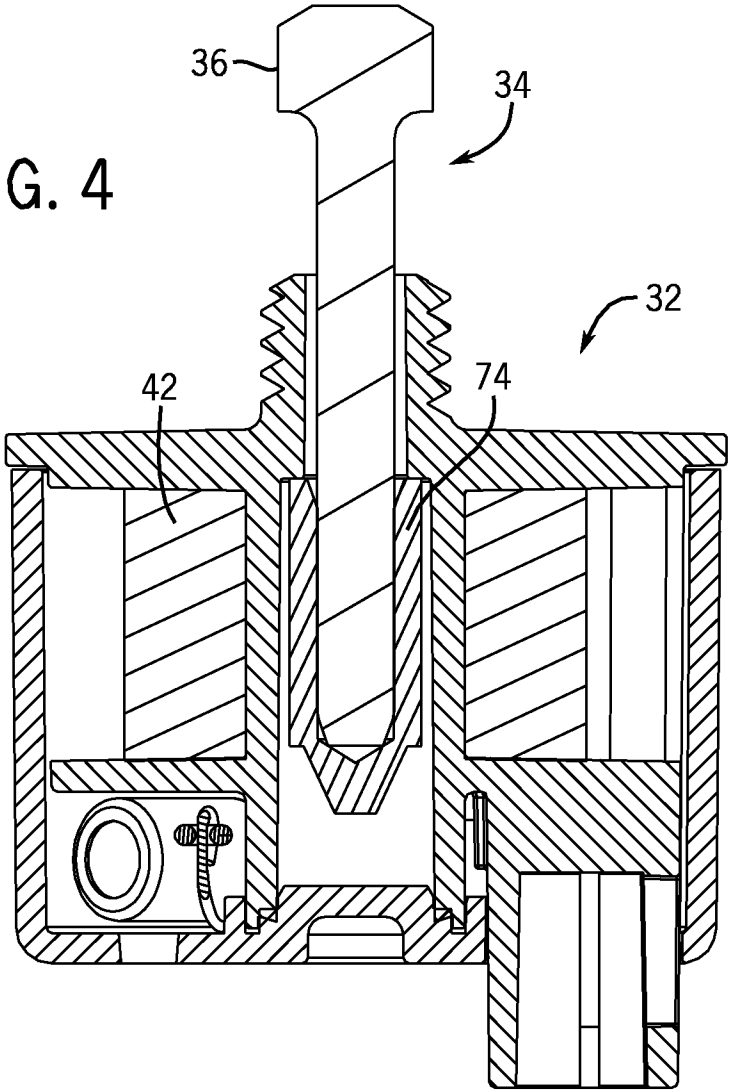
FIG. 4 is a cross-section view similar to FIG. 3 illustrating the fuel flow control device in its second position.
Figure 3:
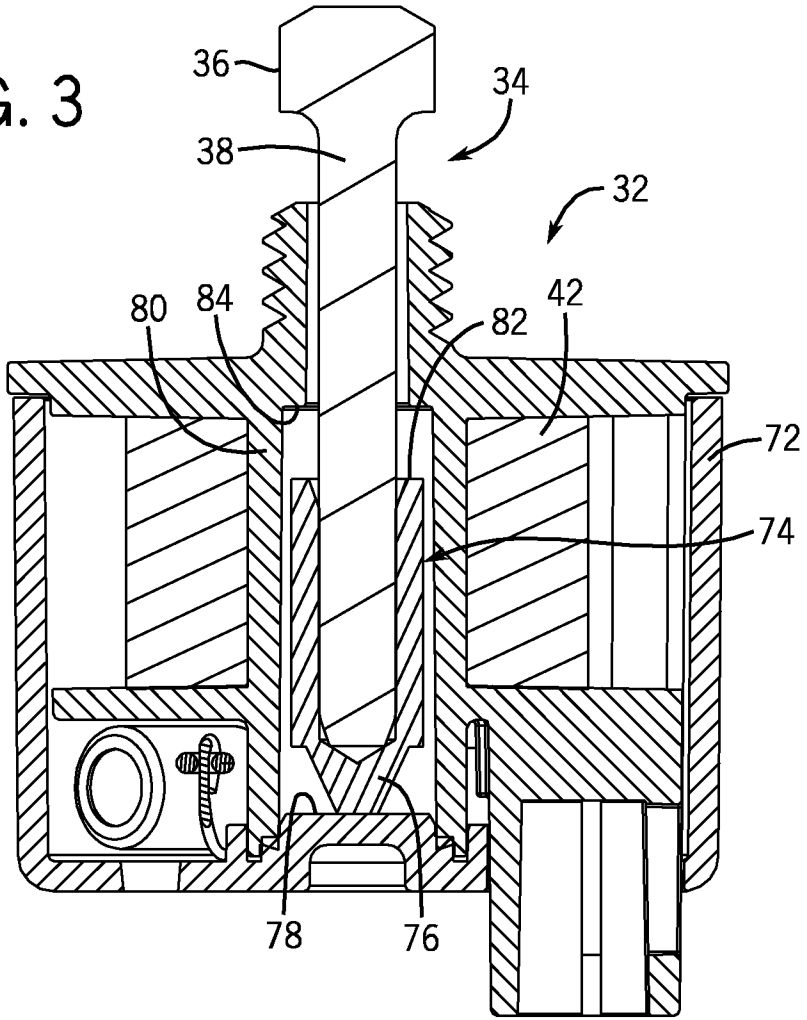
FIG. 3 is a cross-sectional view of a fuel flow control device in its first position.

FIGS. 3 and 4 illustrate a preferred embodiment of the fuel flow control device 32 constructed in accordance with the present disclosure. FIG. 3 illustrates the fuel flow control device 32 in its first, retracted position, while FIG. 4 illustrates the fuel flow control device in its second, extended position.

As illustrated in FIG. 3, the fuel flow control device 32 includes an outer shell 72 that receives the operating components of the fuel flow control device 32. The control member 34 is shown in the embodiment of FIG. 3 as a plunger having the expanded diameter head portion 36 and a generally cylindrical shaft 38. In the embodiment illustrated, the head portion 36 and the shaft 38 are integrally formed with each other from a plastic material. The lower portion of the shaft 38 is press fit within a plunger tip 74 formed from a ferromagnetic material. Although a two-piece control member 34 is shown, the control member 34 could be fabricated entirely from a ferromagnetic material. When the control member 34 is in its first, retracted position of FIG. 3, the bottom end 76 of the plunger tip 74 contacts a wall 78.

The electromagnetic coil 42 is shown in FIG. 3 surrounding the lower portion of the shaft 38 and the plunger tip 74. In the embodiment illustrated, the electromagnetic coil 42 includes a plurality of windings extending around a central bobbin 80. The number of windings and the size of the wire wound around the bobbin 80 controls the magnetic force created by the electromagnetic coil 42.

As illustrated in FIG. 3, when no current is supplied to the electromagnetic coil 42, the control member is biased into its first, retracted position by gravity. When the control member 34 is in this biased position, fuel can flow into the carburetor 10, as illustrated in FIG. 1. Although the fuel flow control device 32 is shown in FIG. 3 as vertically oriented such that gravity provides the required bias force, if the fuel flow control device 32 were horizontally oriented, a bias spring could be inserted between the top edge 82 of the plunger tip 74 and the inner wall 84. Such bias spring would be sized appropriately such that the spring would provide the required bias force to move the control element 34 to the position shown in FIG. 3 without overly restricting the movement of the control member 34 to its extended position shown in FIG. 4. Since the current induced within the primary ignition coil after operation of the internal combustion engine is terminated is relatively small, it is important that any bias force created by a spring be matched with the EMF created by the electromagnetic coil 42.

Referring now to FIG. 4, once the kill switch 62 has been closed, current from the primary ignition coil is fed through the electromagnetic coil 42. The current flowing in the coil 42 creates a magnetic field strong enough to move the control member 34 into the second, extended position shown in FIG. 4. Specifically, the ferromagnetic material of the plunger tip 74 is drawn upward to the position shown in FIG. 4 and is held in this position as long as current continues to be applied to the electromagnetic coil 42. In this position, the expanded head portion 36 closes and blocks the inlet opening 30 shown in FIG. 1 to prevent any further fuel flow.

The expanded head portion 36 is held in the extended position shown in FIG. 4 until the induced current received by the electromagnetic coil 42 is no longer sufficient to hold the control member 34 against either the force of gravity or a spring bias force. Thus, as the rotation of the internal combustion engine slows to a stop, the control member 34 returns to its retracted position of FIG. 3. The configuration of the fuel flow control device 32 ensures that fuel can flow into the carburetor at startup since the control member 34 is positioned to allow the flow of fuel into the carburetor.

In the embodiment shown in the Figures, one specific configuration of the fuel flow control device is shown. However, it should be understood that various other types of fuel flow control devices could be designed while operating within the scope of the present disclosure. Specifically, various other fuel flow control devices could be designed utilizing an electromagnetic coil energized by the induced current from within the primary ignition coil after the kill switch for the internal combustion engine has been activated. The electromagnetic coil could move other types of control elements while operating within the scope of the present disclosure.

I claim:

1. A fuel control system for use with an internal combustion engine having a primary ignition coil and a combustion chamber, comprising:

a fuel flow control device operable to control the flow of fuel to the combustion chamber, the fuel flow control device having a control member movable between a first position to permit the flow of fuel to the combustion chamber and a second position to prevent the flow of fuel to the combustion chamber; and a kill switch operable to stop operation of the engine and movable between a first condition and a second condition, wherein only when the kill switch is moved from the first condition to the second condition to stop operation of the engine, the primary ignition coil discharges induced current through the fuel flow control device to move the control member to the second position.

2. The fuel control system of claim 1 wherein the fuel flow control device includes an electromagnetic coil, wherein the primary ignition coil discharges the induced current through the electromagnetic coil to move the control member to the second position.

3. The fuel control system of claim 2 wherein the control member is biased into the first position.

4. The fuel control system of claim 3 wherein the control member is a plunger movable relative to the electromagnetic coil.

5. The fuel control system of claim 3 wherein the control member moves to the first position upon termination of rotation of the internal combustion engine.

6. The fuel control system of claim 2 wherein the kill switch is positioned between the electromagnetic coil and ground such that the primary ignition coil discharges directly to ground through the electromagnetic coil and the kill switch upon movement of the kill switch to the second condition.

7. The fuel control system of claim 2 further comprising a capacitor positioned between the primary ignition coil and the electromagnetic coil, wherein the induced current from the primary ignition coil charges the capacitor only after the kill switch is moved to the second condition.

8. The fuel control system of claim 7 further comprising a diode connected to the capacitor and positioned in parallel with the electromagnetic coil.

9. A fuel control system for use with an internal combustion engine having a primary ignition coil, a carburetor and at least one cylinder, the system comprising:

a fuel flow control device positioned to control the flow of fuel from the carburetor to the at least one cylinder, the fuel flow control device being movable between a first position to permit the flow of fuel from the carburetor to the at least one cylinder and a second position that restricts the flow of fuel from the carburetor to the at least one cylinder;

an electromagnetic coil contained within the fuel flow control device and coupled to the primary ignition coil, wherein the electromagnetic coil is operable to move the fuel flow control device between the first and second positions; and a kill switch operable to stop operation of the engine and positioned between the electromagnetic coil and ground, the kill switch being movable between a first condition and a second condition, wherein when the kill switch is moved to the second condition to stop operation of the engine, the primary ignition coil discharges induced current to ground through the electromagnetic coil to move the fluid flow control device to the second position.

10. The fuel flow control system of claim 9 wherein the fuel flow control device includes a control member movable between the first and second positions, wherein the electromagnetic coil controls at least part of the movement of the control member.

11. The fuel flow control system of claim 10 wherein the control member returns to the first position upon termination of rotation of the internal combustion engine.

12. The fuel flow control system of claim 10 wherein the control member is a plunger having an expanded head portion and a shaft, wherein the shaft includes a ferromagnetic material positioned to move relative to the electromagnetic coil.

13. The fuel flow control system of claim 9 wherein the fuel flow control device is biased into the first position such that movement of the kill switch to the second condition causes the fuel flow control device to move to the second position.

14. The fuel flow control system of claim 9 further comprising a capacitor positioned between the primary ignition coil and the electromagnetic coil, wherein the induced current from the primary ignition coil charges the capacitor only after the kill switch is moved to the second condition.

15. The fuel flow control system of claim 14 further comprising a diode connected to the capacitor and positioned in parallel with the electromagnetic coil.

16. A fuel control system for use with an internal combustion engine having a rotating flywheel and a primary ignition coil positioned relative to the rotating flywheel such that the rotating flywheel induces current within the primary ignition coil, the system comprising:

a fuel flow control device positioned to control the supply of fuel to the engine, the fuel control device having an electromagnetic coil surrounding a movable control member, wherein upon energization of the electromagnetic coil, the control member moves from a first position to a second position to limit the supply of fuel to the engine;

a capacitor positioned between the primary ignition coil and the electromagnetic coil;

a diode connected to the capacitor and positioned in parallel with the electromagnetic coil; and a kill switch positioned between the electromagnetic coil and ground, wherein when the flywheel is rotating and the kill switch is closed, the current induced in the primary ignition coil by the rotating flywheel flows through the electromagnetic coil to ground and moves the control member to the second position.

17. The fuel control system of claim 16 wherein the control member is biased into a first position such that the control member is in the first position except during energization of the electromagnetic coil.

18. The fuel control system of claim 17 where the control member is biased into the first position by at least one of gravity and a spring.

19. The fuel control system of claim 16 wherein the combination of the capacitor and the diode combine to provide only positive voltage to the electromagnetic coil after the kill switch is closed.

* * * * *